US005455984A

United States Patent [19]

Blase

[11] Patent Number: 5,455,984

[45] Date of Patent: Oct. 10, 1995

[54] CLEANING MACHINE AND CONTROL SWITCH THEREFOR

[75] Inventor: Michael Blase, Grand Rapids, Mich.

[73] Assignee: Bissell Inc., Grand Rapids, Mich.

[21] Appl. No.: 115,463

[22] Filed: Sep. 1, 1993

[51] Int. Cl.[6] ..... A47L 9/24

[52] U.S. Cl. ..... 15/339; 15/377; 15/410; 15/DIG. 10

[58] Field of Search ..... 15/321, 322, 339, 15/DIG. 10; 200/81.4

[56] References Cited

U.S. PATENT DOCUMENTS

| | | | |
|---|---|---|---|
| 2,292,435 | 8/1942 | Crites | 15/321 |
| 3,780,397 | 12/1973 | Harbeck et al. . | |
| 3,815,172 | 6/1974 | Fromknect et al. . | |
| 3,873,790 | 3/1975 | Coons | 15/DIG. 10 |
| 3,908,223 | 9/1975 | Brooks et al. . | |
| 3,939,527 | 2/1976 | Jones | 15/321 |
| 4,316,304 | 2/1982 | Parise et al. . | |
| 4,447,930 | 5/1984 | Glenn | 15/321 |
| 4,659,924 | 4/1987 | Getz | 15/339 |
| 4,787,117 | 11/1988 | Westergren | 15/339 |
| 4,893,375 | 1/1990 | Girman | 15/322 |
| 4,951,346 | 8/1990 | Salmon | 15/321 |
| 4,998,317 | 3/1991 | Passien . | |

*Primary Examiner*—David A. Scherbel
*Assistant Examiner*—Terrence R. Till
*Attorney, Agent, or Firm*—Varnum, Riddering, Schmidt & Howlett

[57] ABSTRACT

A switch and connector for selectively creating an electrical circuit between a motor mounted in a power foot and a combination vacuum cleaning/water extraction machine is disclosed. The motor mounted in the power foot drives an agitation member rotatively mounted in the power foot. The power foot is inter-connected to the housing of the machine through a rigid wand, a grip tube and a flexible hose. A pneumatic switch is mounted in the electrical circuit between the source of electricity and the power foot motor. A bladder is mounted to the grip tube and in fluid communication with the pneumatic switch through a conduit. The bladder is constructed such that the pneumatic switch cannot be activated to create a complete electrical circuit between the source of electricity and the power foot motor unless the grip tube and wand are properly assembled.

16 Claims, 11 Drawing Sheets

CLEANING MACHINE AND CONTROL SWITCH THEREFOR

BACKGROUND OF THE INVENTION

1. Field of the Invention

This invention relates to cleaning machines such as vacuum cleaning machines and water extraction machines and, more particularly, to a water extraction machine having an improved switch for controlling the supply of electricity to a power foot.

2. Description of Related Art

Carpeting and other floor surfaces have long been cleaned by using a vacuum cleaning machine which applies suction through a nozzle to the floor surface. Experience has shown that agitating the carpet strands with a rotating brush or beater bar improves the cleaning performance of the vacuum cleaning machine. Agitation members are typically mounted in the nozzle of an upright vacuum or the foot of a canister vacuum. The agitation member is usually driven by an agitation motor mounted adjacent the agitation member and interconnected thereto by a belt. The traditional power foot has an electric motor mounted in the power foot which is linked to the rotating agitation member by a belt or other interconnection.

Water extraction or deep cleaning is another process which can be used to clean carpeting or other floor surfaces. In this process, cleaning solution is sprayed onto the carpet surface and is then removed by an appropriate source of suction. The water extraction process can be more effective at removing dirt and dust from the carpet or floor surface than traditional vacuuming or vacuuming with an agitation member.

The cleaning performance of water extraction machines can be improved similar to the performance of vacuum cleaning machines through the incorporation of a rotating agitation member. The rotating agitation member helps to drive the cleaning solution deeper into the carpeting and also acts as a liquid media to aid in removing dirt and dust trapped in the carpet.

One significant problem with using a power foot with a water extraction machine is to provide an adequate separable connection between the power foot and the extraction machine. Such a device intended for use by consumers must pass several safety tests in order to receive certain consumer certifications. For example, Underwriter's Laboratories, Inc. ("UL") requires that all or a portion of the electrical power interconnection between the water extraction machine housing and the power foot be immersible in water and yet not result in electrical shock to the user. Such rigorous testing requirements presents a considerable challenge in engineering a suitable interconnection and electrical circuit between the power foot and the housing of a water extraction machine.

One mechanism which is designed to provide a waterproof electrical connector for an electrified vacuum hose is disclosed in U.S. Pat. No. 4,316,304 issued Feb. 23, 1982 to Parise et al. This connection assembly comprises a cylindrical plunger mounted within a plastic cuff. The cuff receives the male prongs of an electrical plug and completes the electrical circuit by moving the plunger within the cuff until it abuts an electrical contact mounted at the other end of the cuff. The plunger is biased such that when the male plug is withdrawn from the cuff, there is an open electrical circuit between the machine housing and the power foot.

SUMMARY OF THE INVENTION

The switch according to the invention overcomes the problems of the prior art by providing a suitable electrical conduit for supplying electricity from the housing of a water extraction or vacuum cleaning machine to a power foot and a suitable interconnection between the power foot and the housing to supply electrical current when the power foot is connected to the housing and to eliminate electrical potential at the connection when the housing is disconnected from the power foot.

According to the invention, a floor cleaning appliance comprises a housing, a source of suction in the housing and a receptacle in the housing for receiving collected dirt and dust. A power foot has a suction nozzle and a conduit extends between the housing and the suction nozzle. The conduit comprises a flexible hose having two ends and a rigid wand having first and second ends. One end of the hose is mounted to the source of the suction in the housing. The first end of the wand is mounted to the power foot and the second end of the wand is selectively mounted to another end of the flexible hose. An agitation member is mounted in the power foot and adapted to agitate the surface to be cleaned. The agitation member has a motor mounted in the power foot and connected to the agitation member for imparting agitation thereto. An electrical circuit is provided between the agitation motor and the housing, the electrical circuit including a connection between the flexible hose and the rigid wand and further includes a normally open agitation motor pneumatic switch. The pneumatic switch is adapted to switch between open and closed positions in response to changes to fluid pressure applied to the switch. The closed position corresponds to a closed electrical circuit between the agitation member motor and the housing and the open position corresponds to an open electrical circuit between the agitation member and the housing. A manual pressure controller is mounted to the flexible hose and connected to the agitation motor pneumatic switch for selectively applying pneumatic pressure to the agitation motor pneumatic switch to close the same. The pressure controller has an opening which, when open, renders the pressure controller ineffective for actuating the agitation motor pneumatic switch. A closure member is mounted on the rigid wand and connected to the manual pressure controller opening for closing the controller when the rigid wand is properly mounted to the flexible hose. In this position the manual pressure controller is operable to supply pneumatic pressure to said agitation motor pneumatic switch when the flexible hose and the rigid wand are properly connected together and to render said manual pressure controller to supply pneumatic pressure to said agitation motor pneumatic switch inoperable when the flexible hose and the rigid wand are disconnected from each other. Thus, the invention provides electrical energy to the connector when the rigid wand is connected to the flexible hose and prevents electrical energy from being supplied to the connector when the rigid wand is not connected to the flexible hose. Desirably, the agitation motor pneumatic switch is mounted in the housing.

In a preferred embodiment of the invention, the manual pressure controller comprises a bladder having an opening formed therein. Further, a fluid conduit interconnects the agitation motor bladder and the agitation motor pneumatic switch. Thus, when the wand and the flexible hose are properly connected, squeezing of the bladder will close the switch and thus close the electrical circuit which includes the agitation motor.

In a preferred embodiment of the invention, the source of suction comprises a vacuum motor and a vacuum motor pneumatic switch is electrically connected to the vacuum motor and adapted to switch between open and closed positions in response to changes in fluid pressure applied to the vacuum motor pneumatic switch. In a closed position, the vacuum motor pneumatic switch closes a second electrical circuit including the vacuum motor. In an open position, the vacuum motor pneumatic switch opens the electrical circuit which includes the vacuum motor.

A second manual pressure controller mounted on one of the flexible hose and the rigid wand is connected to the vacuum motor pneumatic switch for manually controlling the pressure applied to the vacuum motor controller switch. In this manner, the operation of the vacuum motor can be controlled from the wand or the flexible hose.

Further, in a preferred embodiment of the invention, a pump motor supplies cleaning fluid from a cleaning solution reservoir to a spray nozzle mounted in the power foot adjacent the suction nozzle. A spray conduit extends between the pump motor and the spray nozzle to convey cleaning solution from the pump motor to the spray nozzle. A pump motor pneumatic switch is electrically connected in a circuit which includes the pump motor and is adapted to switch between open and closed positions in response to changes in fluid pressure in the pump motor pneumatic switch. In the closed position, an electrical circuit including the pump motor is closed. In the open position, an electrical circuit including the pump motor is open. A third manual pressure controller is mounted on one of the flexible hose and the rigid wand and connects to the pump motor pneumatic switch for manually controlling the pressure applied to the pump motor pneumatic switch. The operation of the pump motor can thus be manually controlled from one of the wand and the flexible hose.

Further, in accordance with a preferred embodiment of the invention, a trigger having a lever arm is mounted on the one of the flexible hose and the wand and is adapted to control the flow of cleaning fluid from the pump motor to the power foot. The third manual pressure controller is mounted between the trigger lever arm and the one of the flexible hose and wand such that the squeezing of the trigger lever arm relative to the one of the flexible hose and wand actuates the third manual release pressure controller.

The invention further comprises an interconnection assembly for use with a floor cleaning appliance where the floor cleaning appliance comprises means for generating suction, a receptacle adjacent the suction means for receiving collected dirt and dust, a suction nozzle, a conduit extends between the receptacle and the suction nozzle. The conduit comprises a flexible hose, a grip tube and a rigid wand. An agitation member is mounted in the suction nozzle and adapted to agitate the surface to be cleaned. An agitation member motor is interconnected to the agitation member and adapted to impart an agitation force to the agitation member. An agitation motor pneumatic switch is electrically connected to the agitation member motor and adapted to switch between on and off positions in response to changes in fluid pressure within the agitation motor pneumatic switch. The on position corresponds to the creation of a complete electrical circuit between the agitation member motor and a source of electricity and the off position corresponds to an open electrical circuit between the agitation member motor and the source of electricity. The interconnection further comprises an agitation motor bladder having an opening formed therein. The opening is adapted to be selectively closed when the flexible hose is properly assembled to the wand and the opening is adapted to remain open when the flexible hose is not properly mounted to the wand. An agitation motor conduit interconnects the agitation motor bladder and the agitation motor pneumatic switch. The agitation motor pneumatic switch selectively closes in response to squeezing of the agitation motor bladder and pressurizing the agitation motor pneumatic switch. When the wand and the flexible base are properly assembled, the opening of the agitation motor bladder is closed and the pressure within the agitation motor bladder is transmitted from the agitation motor bladder, through the agitation motor conduit and to the agitation motor pneumatic switch, thereby closing the switch. However, the agitation motor pneumatic switch is not closed by squeezing the agitation motor bladder when the wand and flexible hose are not properly assembled. The pressure within the agitation motor bladder resulting from squeezing the bladder is released through the opening of the bladder rather than being transmitted through the agitation motor conduit to the agitation motor switch.

In a further embodiment, a vacuum motor pneumatic switch is electrically connected to a vacuum motor and adapted to switch between open and closed positions in response to changes in fluid pressure in the vacuum motor pneumatic switch. The closed position corresponds to the creation of a complete electrical circuit between the vacuum motor and the source of electricity and the open position corresponds to an open electrical circuit between the vacuum motor and the source of electricity. The vacuum motor bladder is interconnected to the vacuum motor pneumatic switch by a vacuum motor conduit. The vacuum motor pneumatic switch selectively closes in response to squeezing of the vacuum motor bladder which results in an increase in the fluid pressure within the vacuum motor pneumatic switch and the vacuum motor pneumatic switch opens when the squeezing pressure on the vacuum motor bladder is released due to the decrease in fluid pressure within the vacuum motor bladder and vacuum motor pneumatic switch.

In yet another embodiment, a pump motor pneumatic switch is electrically connected to a pump motor within the floor cleaning appliance. The switch is adapted to switch between open and closed positions in response to changes in fluid pressure in the pump motor pneumatic switch, the closed position closes the electrical circuit between the pump motor and the source of electricity and the open position opens the electrical circuit between the pump motor and the source of electricity. A pump motor bladder is interconnected to the pump motor pneumatic switch by a pump motor conduit. The pump motor pneumatic switch selectively switches to the closed position in response to squeezing of the pump motor bladder which results in an increase in the fluid pressure within the pump motor pneumatic switch. The pump motor pneumatic switch switches to the open position when the squeezing pressure on the pump motor bladder is released due to the decrease in fluid pressure within the pump motor bladder and the pump motor pneumatic switch.

In a preferred embodiment, the conduit further comprises a grip tube mounted intermediate the flexible hose and the wand.

In one embodiment, the interconnection comprises a projection mounted to the wand and adapted to be received in the agitation motor bladder opening to close the bladder opening when the grip tube is properly mounted to the wand.

In another embodiment, the interconnection comprises a tongue formed on one of the second end of the grip tube and the wand and a complementary groove formed on the other of the second end of the grip tube and the wand. The bladder openings are adapted to be closed when the tongue and groove are interengaged.

BRIEF DESCRIPTION OF THE DRAWINGS

The invention will now be described with reference to the drawings wherein.

DESCRIPTION OF THE PREFERRED EMBODIMENTS

Figure 1:
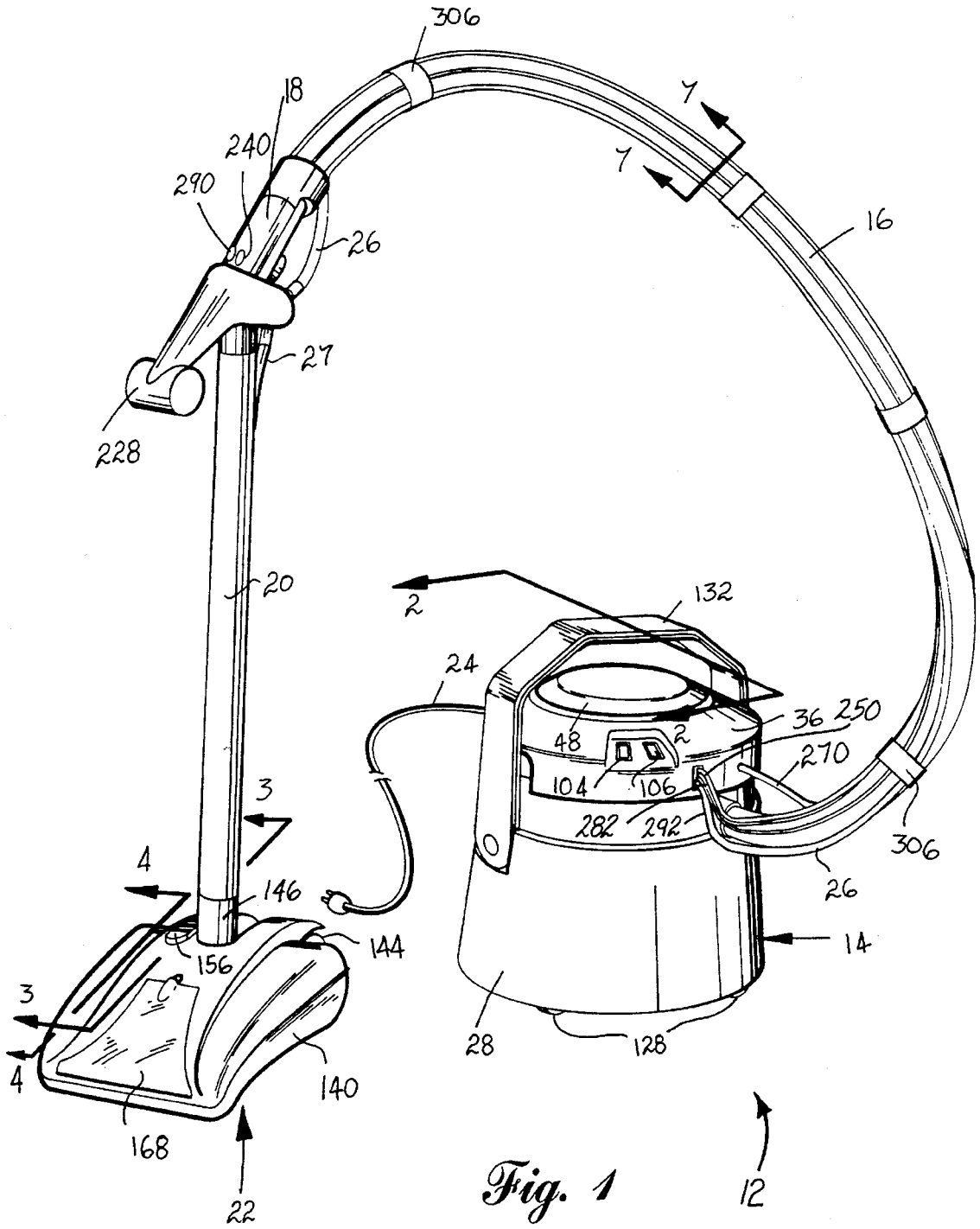
FIG. 1 is a perspective view of a combination vacuum cleaning/water extraction machine according to the invention.

Referring now to the drawings and to FIG. 1 in particular, a combination vacuum cleaning/water extraction machine 12 comprises a housing 14, a flexible conduit or hose 16, a wand 20 and a power foot 22. The housing 14 comprises a solution chamber housing 28 and a motor housing 36 mounted on top of the solution chamber housing 28. Casters 128 and a handle 132 are mounted to the housing 14 to permit easy movement of the machine 12. One end of the flexible conduit 16 is mounted to the housing 14 and the other end of the flexible conduit 16 terminates in a hollow grip tube 18. The grip tube 18 is adapted to be selectively mounted to a wand 20. The wand 20 comprises a rigid hollow tube which extends from the grip tube 18 to the power foot 22. The power foot 22 rides over the surface to be cleaned. An electrical cord 24 connects the machine 12 to a suitable source of electricity. A pair of toggle switches 104, 106 are mounted to the motor housing 36 for turning on and off the vacuum motor and pump motor, described further below.

A first electrical cord 270 extends from the motor housing 36 along the flexible conduit 16 to the grip tube 18. A first solution tube 26, a first agitation member conduit 250, a pump motor conduit 282 and a vacuum motor conduit 292 also extend from the vacuum motor housing 36 to the grip tube 18. A second solution tube 27 is mounted to the wand 20, extends from the grip tube 18 to the power foot 22 and is in fluid communication with the first solution tube 26. A handle 228 is mounted to the grip tube 18.

Figure 3:
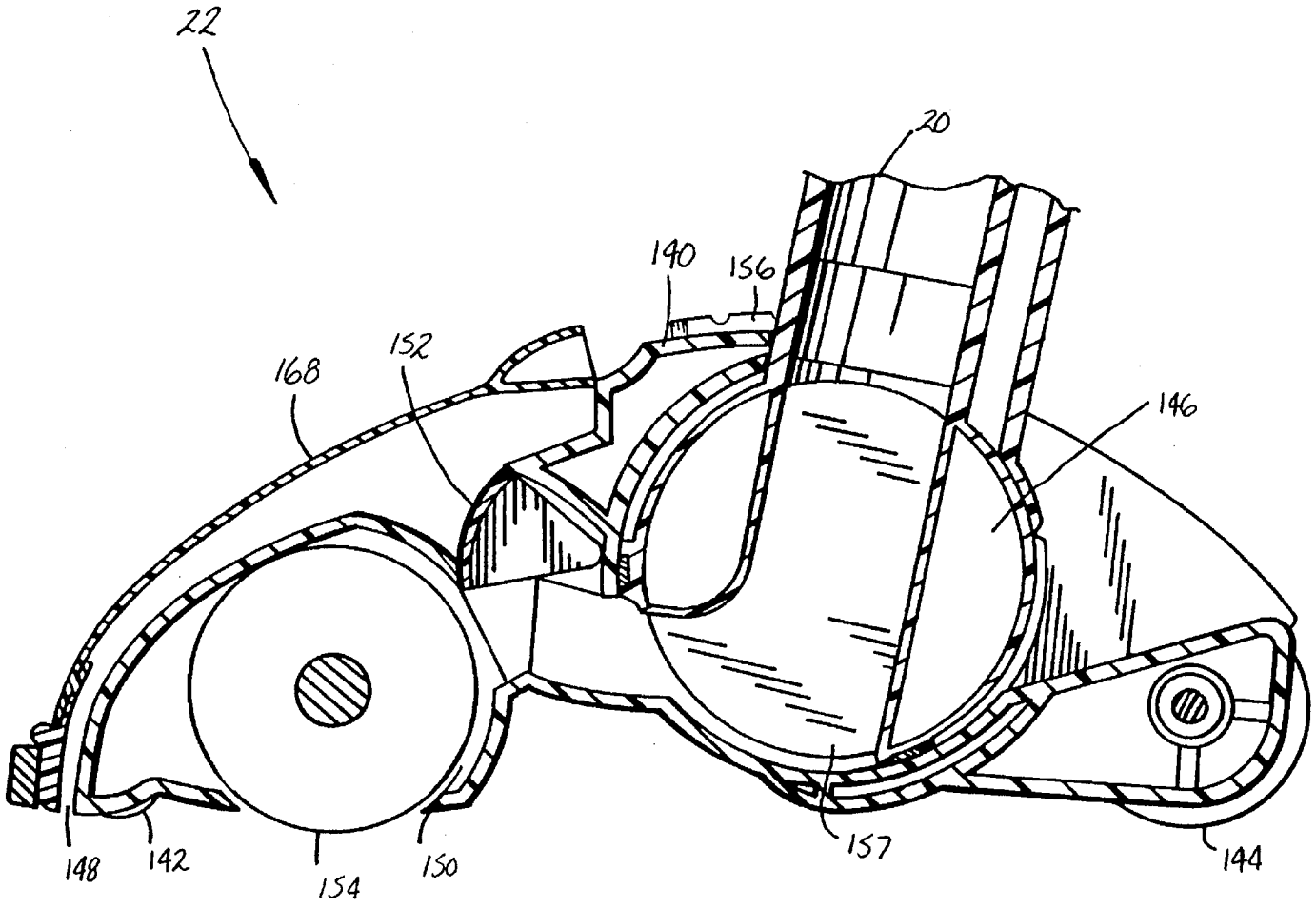
FIG. 3 is a sectional view of a power foot suitable for use according to the invention taken along lines 3—3 of FIG. 1.

Referring to FIGS. 1 and 3, the lower end of the wand 20 is received in a wand mounting 146 of the power foot 22. Rear wheels 144 are mounted to the rear of the power foot housing 140. A switch 156 is mounted to the top of the housing for switching the power foot 22 between dry vacuuming and water extraction processes. Alternatively, the extraction machine 12 can be adapted solely for use for a water extraction process, wherein the switch 156 is not necessary. A transparent cover 168 is mounted to the front of the housing 140 so that the user can observe the dirty water being picked up by the power foot 22 during use as a water extraction machine.

In use as a water extraction machine, cleaning solution is conveyed from the housing 14 to the power foot 22 through the solution tubes 26 and 27. A source of suction is applied to the surface to be cleaned from the housing 14 through the hollow interior of the flexible conduit 16, grip tube 18, wand 20 and power foot 22. The used cleaning solution, dirt and dust are lifted from the floor and are returned to the housing 14 through the power foot 22, wand 20, grip tube 18 and flexible conduit 16.

Figure 2:
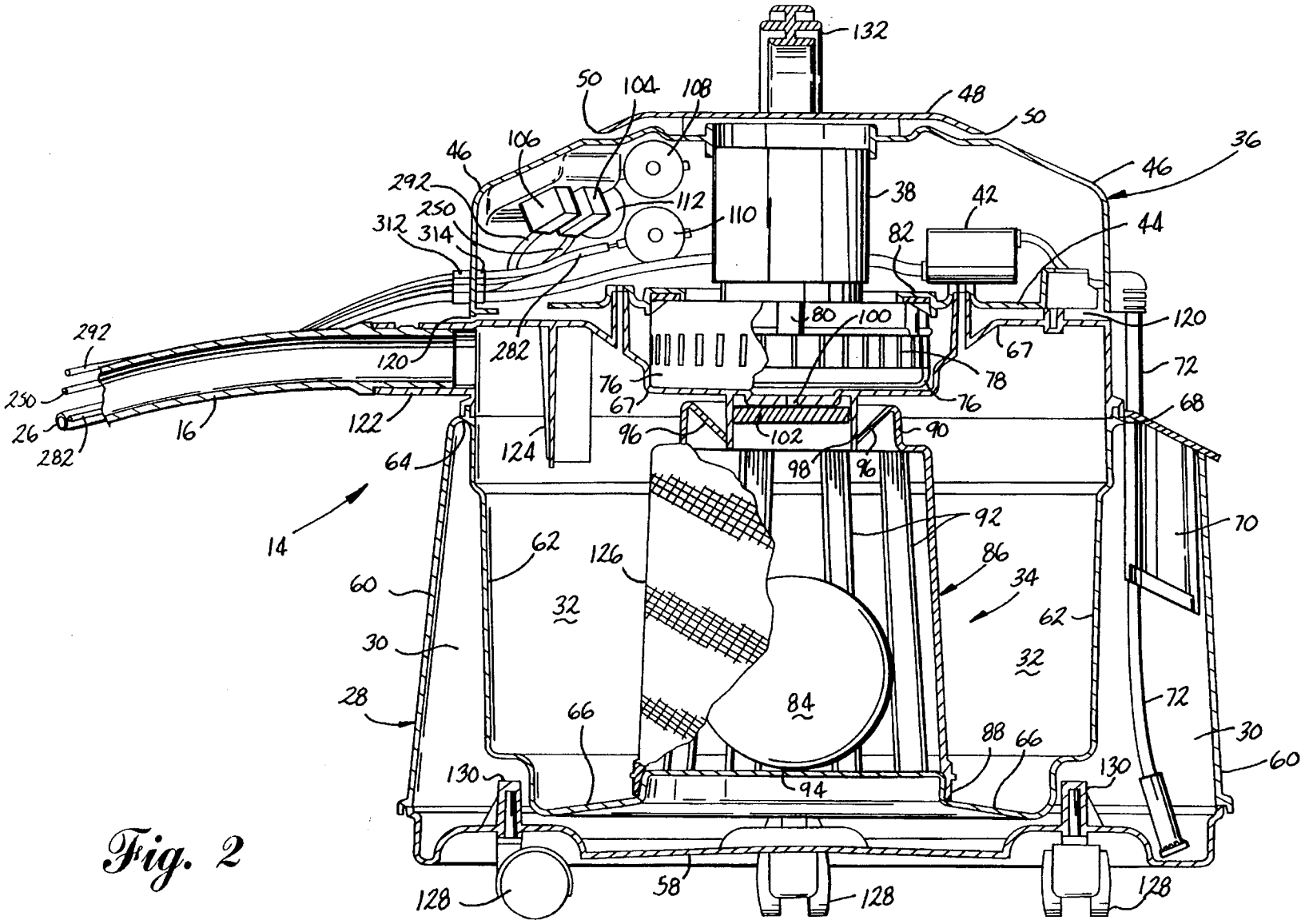
FIG. 2 is a partial sectional view of the housing of the combination vacuum cleaning/water extraction machine taken along lines 2—2 of FIG. 1.

As seen in FIG. 2, the solution chamber housing 28 comprises a circular clean solution chamber 30, a circular dirty solution chamber 32, and a safety flow valve 34. Preferably, the dirty solution chamber 32 is mounted concentrically within the clean solution chamber 30.

The clean solution chamber 30 is defined by a base wall 58, an outer side wall 60 extending upwardly from the base wall 58, an intermediate side wall 62 extending upwardly from the base wall 58, a top wall 64 extending between the top edges of the side walls 60, 62 and an intermediate base wall 66 mounted to the bottom edge of the intermediate side wall 62 a spaced distance above the base wall 58. A loading/discharge aperture 68 is formed in the top wall 64 of the clean solution chamber 30 and is adapted to receive clean water for use in the water extraction cleaning process. The aperture 68 is closed by a measuring cup 70 which is selectively mounted in the aperture 68. In use, the user fills the measuring cup 70 with the desired amount of cleaning solution and pours the solution into the clean solution chamber 30 through the aperture 68 and mounts the measuring cup 70 inverted in the aperture 68 during operation of the machine 12.

Clean solution is conveyed to the pump motor 42 through a clean solution tube 72 which extends between the pump motor 42 and the bottom of the clean solution chamber 30.

The dirty solution chamber 32 is defined by the intermediate base wall 66 which is joined to the bottom edge of the intermediate side wall 62 which is joined at its top edge to a top wall 67 of the dirty solution chamber 32.

The motor housing 36 is mounted on top of the solution chamber housing 28 and supports a vacuum motor 38 and a pump motor 42. The motor housing 36 has a base wall 44 and a side wall 46. A cap 48 is mounted to the top edge of the side wall 46 such that an annular space 50 exists between the cap 48 and the top edge of the side wall 46. Heat generated by the vacuum motor 38 and pump motor 42 are vented to the environment through the annular space 50.

A fan housing 76 is mounted between the base wall 44 of the motor housing 36 and the top wall 67 of the dirty solution chamber 32. The vacuum motor 38 is mounted immediately above the fan housing 76 such that the drive shaft 80 of the motor 38 extends downwardly from the motor 38 into the fan housing 76. An impeller fan 78 is mounted to the drive shaft within the fan housing 76. A seal 82 formed from a pliable elastomeric material is mounted between the upper edge of the fan housing 76 and the base wall 44 of the motor housing 36.

A safety float valve 34 comprising a float 84 received within a cage 86 is mounted immediately below the fan 78 and fan housing 76. The cage comprises a base ring 88, a top ring 90 and a plurality of spaced arms 92 extending between the base ring 88 and top ring 90. The base ring 88 is removably received on an upwardly extending boss 94 formed on the intermediate base wall 66 of the clean solution chamber. A flange 96 extends inwardly and downwardly from the top ring 90 of the cage 86. The flange 96 receives a downwardly extending suction boss 98 formed in the top wall 67 of the dirty solution chamber 32. The suction boss 98 is mounted immediately below the fan housing 76 and impeller fan 78. An aperture 100 is formed in the top wall 67 of the dirty solution chamber 32 within the suction boss 98 and a secondary filter 102 is mounted within the suction boss 98 such that it substantially covers the aperture 100.

In the preferred embodiment, a pair of toggle switches 104 and 106 are mounted to the side wall 46 of the motor housing 36. The first toggle switch 104 is part of the electrical circuit for the vacuum motor 38 and the second toggle switch 106 is part of the electrical circuit for the pump motor 42. In addition, three different pneumatic switches are incorporated into the electrical circuit of the machine. The first pneumatic switch 108 is dedicated to the vacuum motor 38, the second pneumatic switch 110 is dedicated to the pump motor 42 and the third pneumatic switch 112 is dedicated to the power foot 22.

In operation as a dry vacuum, the vacuum motor 38 rotates the impeller fan 78 within the fan housing 76 to create a source of suction. Air is drawn into the dirty solution chamber 32 through the wand mounting 122. From the dirty solution chamber 32, the air passes through a dry filter 126 selectively mounted on the cage 86, through the secondary filter 102, the aperture 100, the fan housing 76 and ultimately out an annular exhaust 120 formed between the solution chamber housing 28 and the motor housing 36. Particles of dirt and dust entrapped in the air stream strike a baffle 124 mounted within the dirty solution chamber 32 immediately adjacent to the wand mounting 122. The baffle 124 deflects the larger pieces of dirt to the bottom of the dirty solution chamber. The dry filter removes the smaller dirt and dust particles from the air stream. The dry filter 126 is mounted on the cage 86 only when the machine is operated in the dry vacuum mode.

When the machine is operated in the water extraction mode, the dry filter 126 is removed and the suction produced by the motor 38 and fan 78 draw the air, dirt and dirty solution into the dirty solution chamber 32 through the wand mounting 122. The solution strikes the baffle 124 and is directed downwardly in the dirty solution chamber for collection. As the level of solution rises within the chamber, the float 84 rises within the cage 86. The solution level may reach a height where the float 84 is received within the opening of the tubular shaped suction boss 98 stopping air flow through the aperture 100, preventing further suction through the flexible conduit 16. The float 84 safeguards against filling the dirty solution chamber 32 with so much water that water would be sucked up into the vacuum motor 38 or up into the fan housing and out the exhaust 120.

For ease of use, the casters 128 are mounted in sockets 130 formed in the base wall 58 of the clean solution chamber 30. In addition, the handle 132 can be pivotally mounted to the motor housing 36 to transport and carry the machine from one location to another.

The basic structure of the machine housing 14, excluding the pneumatic switches 108, 110, 112 is commercially available from BISSELL Inc. of Grand Rapids, Mich. under the model name THE BIG GREEN CLEAN MACHINE™.

The vacuum cleaning/water extraction machine 12 according to the invention is intended to be used with a power foot having an agitation member rotatively mounted therein wherein the foot can be used for both dry vacuum cleaning and water extraction cleaning. An example of a power foot suitable for use according to the invention is disclosed in U.S. patent Ser. No. 08/000273 filed Jan. 4, 1993 and assigned to BISSELL Inc.

Figure 4:
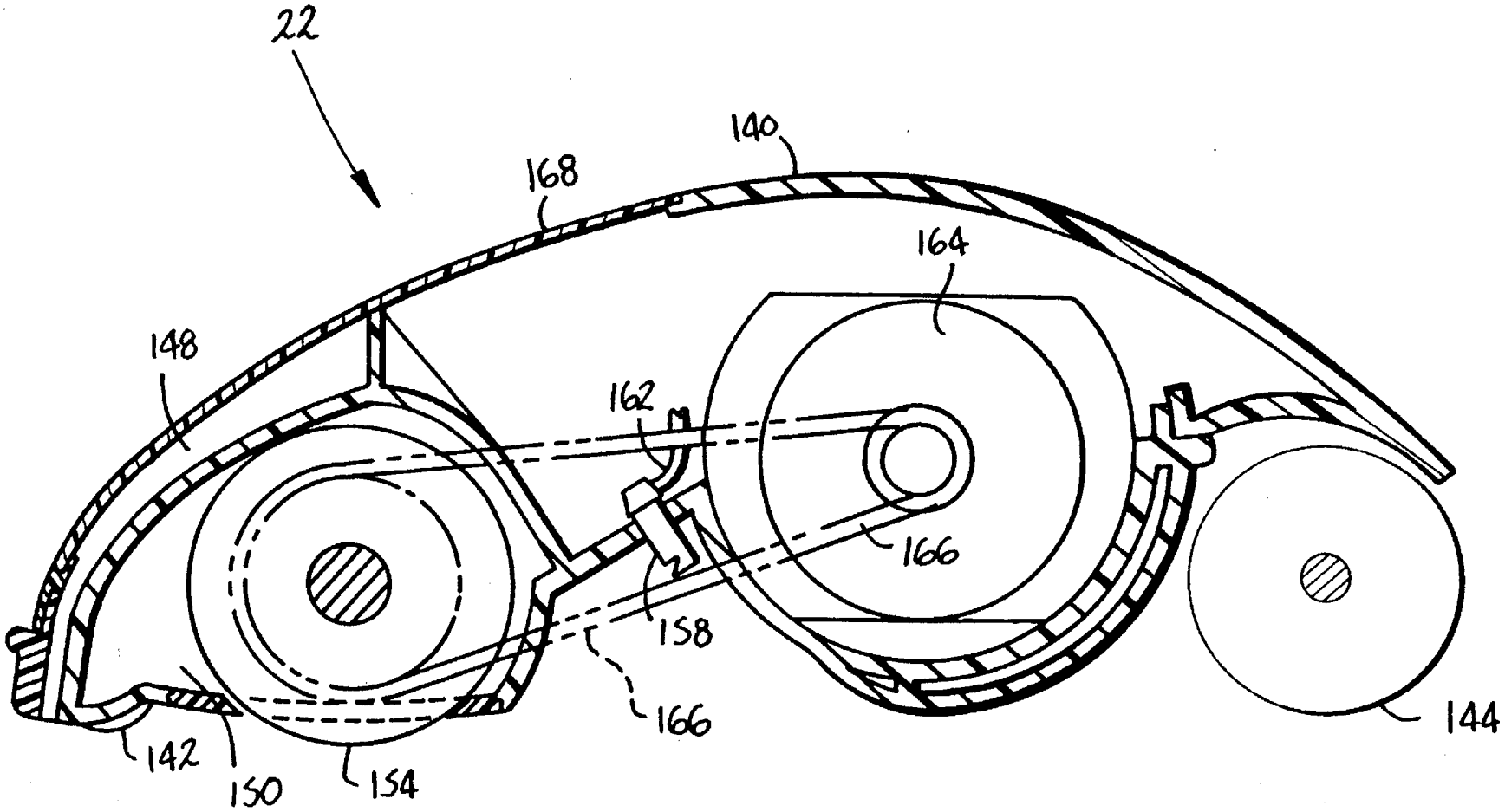
FIG. 4 is a sectional view of the power foot taken along lines 4—4 of FIG. 1.

As seen in FIGS. 3 and 4, the power foot comprises a housing 140 having a pair of front wheels 142, a pair of rear wheels 144 and a wand mounting 146 supported therein. The wand mounting 146 has a circular base and is rotatably mounted in the power foot housing 140. The power foot 22 further comprises a water extraction nozzle 148, a dry vacuum nozzle 150 and a diverter valve member 152 to selectively control the flow of air within the power foot 22 between the water extraction nozzle 148 and the dry vacuum nozzle 150. The air, dirt and water flow from one of the water extraction nozzle 148 and dry vacuum nozzle 150 through the housing 140 to a connector conduit 157 in the wand mounting where the air, dirt and water are then conveyed to the wand 20 and ultimately to the dirty solution chamber 32.

As seen in FIG. 4, at least one cleaning solution spray nozzle 158 is mounted in a recess 160 formed on the bottom of the power foot housing 140. The nozzle 158 receives cleaning solution from the clean solution chamber 30 through the solution conduit 162 which is in fluid communication with the second solution tube 27.

An agitation member motor 164 is mounted in the power foot housing 140 and interconnected through a drive belt 166 and pulley wheels to the agitation member 154 in conventional fashion. The agitation member motor 164 receives electricity from the combination vacuum cleaning/water extraction machine 12 through electrical cords 270, 274.

The invention has an effective interconnection between the power foot 22 and the machine housing 14. The electrical control for the power foot centers around the interconnection between the grip tube 18 and wand 20, and the pneumatic switches mounted in the machine 12.

Figure 5:
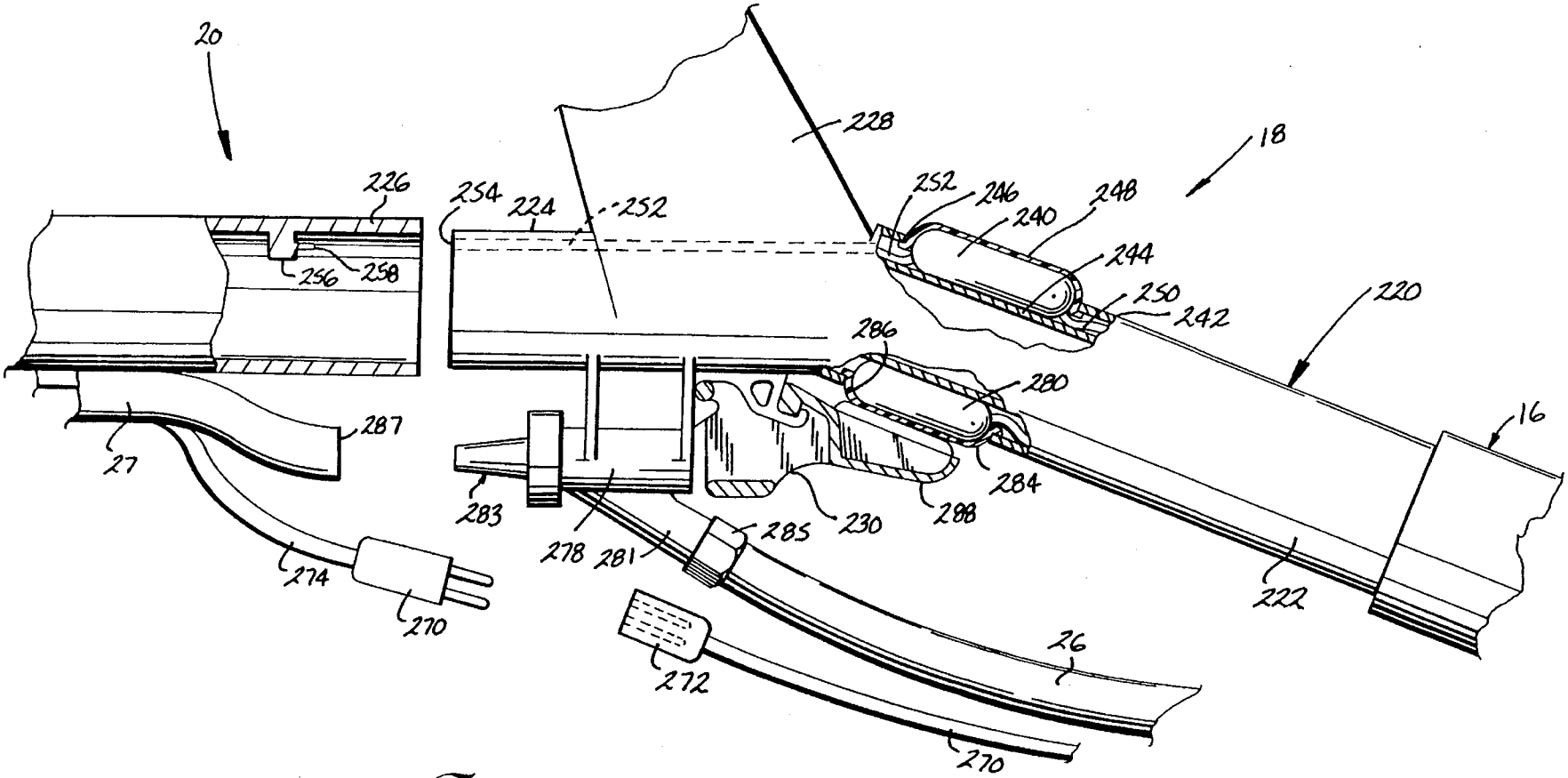
FIG. 5 is a partial sectional view of a first embodiment of the grip tube and wand interconnection according to the invention.

As seen in FIG. 5, the grip tube 18 comprises a tubular body 220 having a first end 222 and a second end 224. The first end 222 is adapted to be mounted to the flexible conduit 16 and the second end 224 is adapted to be received in the first end 226 of the wand 20. Preferably, the outside diameter of the second end 224 of the grip tube 18 is slightly less than the inside diameter of the first end 226 of the wand 20. A handle 228 is mounted to the top surface of the tubular body 220. The solution tube 26 extends from the pump motor 42 to the valve housing 278. The second solution tube 27 extends from the valve housing 278 to the power foot 22. One end of the first solution tube 26 is mounted to a tubular fitting 281 of the valve housing 278 by a threaded nut 285. One end 287 of the second solution tube 27 is slidably received on a tapered connector 283 of the valve housing 278. A solution trigger 230 is linked to a valve (not shown) mounted within the valve housing 278. The trigger 230 and valve control the flow of solution supplied to the cleaning solution nozzle 158 from the pump motor 42 through the solution tubes 26 and 27. The valve (not shown) and trigger 230, are conventional for water extraction machines.

The first end 222 of the grip tube has an outer casing 242 and an inner casing 244 concentrically mounted within the outer casing 242 defining an annular space therebetween. An agitation motor bladder 240 is mounted in an aperture 246 formed in the outer casing 242. The bladder is formed of a soft, pliable material and comprises a hollow chamber in which a suitable fluid such as air can be stored. The bladder is large enough such that a portion of the bladder extends outwardly of the surface of the tubular body 220. Preferably, an elastomeric cover 248 is mounted in the aperture 246 to cover the agitation motor bladder 240 and protect it from the environment. The bladder 240 is in fluid communication with the power foot pneumatic switch 112 (FIG. 2) through the agitation member conduit 250. The conduit comprises a hollow elastomeric tube and mounted in the annular space of the grip tube 18 and extends along the flexible conduit 16 to the motor housing 36. The agitation motor bladder 240 has a second agitation conduit 252 extending from the bladder 240 to the second end 224 of the grip tube. The second agitation member conduit 252 comprises a hollow elastomeric tube and is open on the end 254 such that when the bladder 240 is squeezed, air easily escapes through the open end 254 of the second agitation conduit 252.

As described above, the second end 224 of the grip tube 18 is adapted to be received in the first end 226 of the wand 20. A stop 256 is formed on the interior of the first end 226 of the wand 20 and projects radially into the hollow wand 20. A plug 258 extends from the stop 256 parallel to the longitudinal axis of the wand 20 toward the end of the wand 20. When the wand 20 is properly assembled with the grip tube 18, the second end 224 of the grip tube abuts the stop 256 and the plug 258 is received in the open end 254 of the second agitation conduit 252. In this assembled state, the open end 254 of the second agitation member conduit 252 is sealed shut such that squeezing the bladder 240 forces air through the first agitation conduit 250 to the power foot pneumatic switch 112 (FIG. 2). Unless the wand 20 is properly mounted to the grip tube 18 such that the plug 258 is received in the open end 254 of the second agitation member conduit 252, then the power foot pneumatic switch cannot be switched to the on position to create a complete electrical circuit between the source of electricity and the agitation member motor 164.

In the preferred embodiment, a first electrical cord 270 extends from the source of electricity along the flexible conduit 16 terminating at the grip tube 18. A female plug 272 is mounted at the terminal end of the first electrical cord 270. A second electrical cord 274 extends from the first end 226 of the wand 20 to the agitation member motor 164. A male plug 276, complementary to the female plug 272, is mounted on the end of the second electrical cord 274. In order to complete the electrical circuit between the source of electricity and the agitation member motor 164, the user must mount the male plug 276 in the female plug 272 and properly assemble the wand 20 and grip tube 18 such that the plug closes the end 254 of the second agitation conduit 252.

When the grip tube 18/wand 20 assembly has been completed, then the user can squeeze the agitation member motor bladder 240 to trip the power foot pneumatic switch 112. If the end 254 of the second agitation conduit 252 is not closed, then the power foot pneumatic switch 112 cannot be tripped and the electrical circuit between the source of electricity and the agitation member motor 164 will not be complete. Therefore, the female plug 272 of the cord 270 will be dead.

As described above, the preferred embodiment also includes a pump motor pneumatic switch 110. As shown in FIG. 2, the switch is mounted in the motor housing 36. A pump motor bladder 280 mounted to the underside of the grip tube 18 is in fluid communication with the pump motor pneumatic switch 112 through a pump motor conduit 282. Similar to the agitation member motor bladder 240, the pump motor bladder 280 comprises a soft, pliable hollow chamber, one portion of which extends outwardly from the outer casing through an aperture 284. An elastomeric cover 286 surrounds the pump motor bladder 280 to protect it from the environment. When the pump motor bladder is squeezed air is forced from the bladder 280 through the pump motor conduit 282 to the pump motor pneumatic switch 110. This change in air pressure in the switch triggers the switch and completes the electrical circuit between the source of electricity and the pump motor 42, thereby turning on the pump motor 42. When the pump motor is turned on, pressurized cleaning solution is conveyed from the clean solution chamber 30 (FIG. 2), through the pump motor 42, the solution tube 26, the valve housing 278, the second solution tube 27 and ultimately to the spray nozzles 158 (FIG. 4) for distribution to the surface being cleaned.

In the preferred embodiment, the pump motor bladder 280 is mounted on the underside of the grip tube 18 immediately below the lever arm 288 of the trigger 230. Therefore, when the user squeezes the lever arm 288 relative to the grip tube 18, the pump motor bladder 280 is similarly squeezed and the pump motor pneumatic switch 112 is tripped.

A vacuum motor bladder 290, identical to the pump motor bladder 280 and comprising a soft, pliable hollow, chamber, is mounted to the top surface of the grip tube 18 (FIG. 1). As seen in FIG. 1, the vacuum motor bladder 290 is mounted immediately adjacent to the agitation member motor bladder 240. The vacuum motor bladder 290 is in fluid communication with the vacuum motor pneumatic switch 108 (FIG. 2) through a vacuum motor conduit 292 (FIG. 2). The vacuum motor bladder 290 operates in the same manner as the pump motor bladder. Namely, the vacuum motor bladder 290 is selectively squeezed by the user which causes air or some other suitable fluid received in the bladder to travel through the vacuum motor conduit 292 to the vacuum motor pneumatic switch 108. The increased air pressure within the switch 108 trips the switch 108 to complete the electrical circuit between the vacuum motor 38 and the source of electricity.

Figure 6:
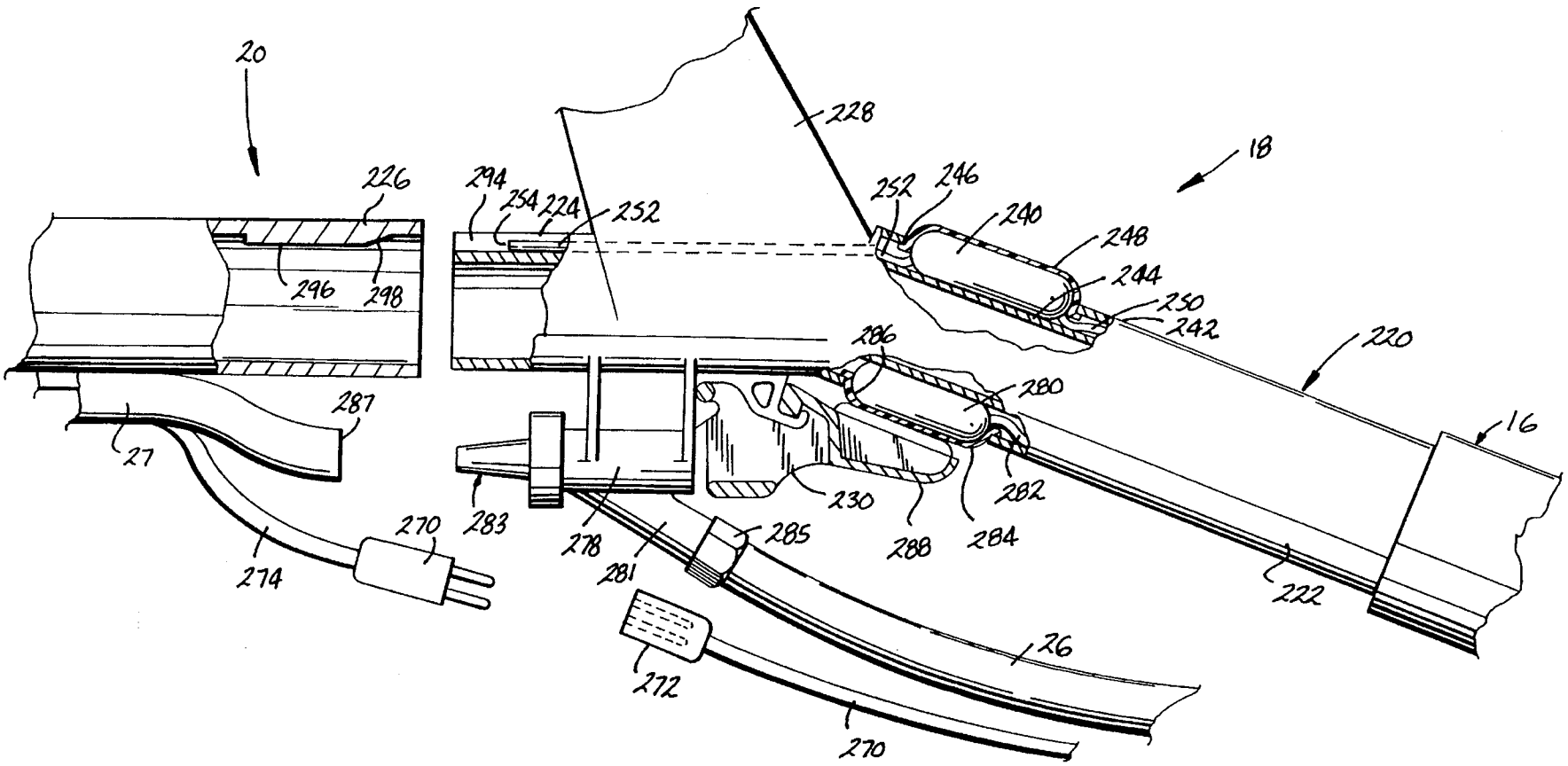
FIG. 6 is a partial sectional view of an alternative embodiment of the grip tube and wand interconnection of FIG. 5.

A second embodiment of the interconnection between the grip tube 18 and wand 20 is seen in FIG. 6. In this embodiment, the second agitation member conduit 252 is mounted in a groove 294 extending along the top surface of the second end 224 of the grip tube 18. A complementary tongue 296 is formed on the interior surface of the first end 226 of the wand 20. As the second end 224 of the grip tube 18 is inserted into the first end 226 of the wand 20, the tongue 296 is received in the groove 294. Eventually, a ramped leading edge 298 of the tongue 296 engages and pinches closed the open end 254 of the second agitation member conduit 252. In this assembled state, as the agitation member bladder 240 is squeezed, fluid in the bladder 240 cannot escape through the closed second agitation member conduit 252 and therefore flows through the first agitation member conduit 250 to the power foot pneumatic switch 112.

Figure 7:
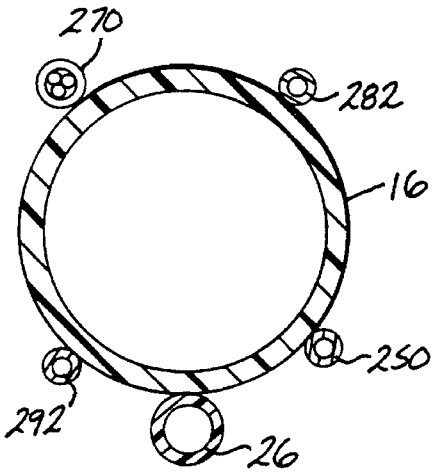
FIG. 7 is a sectional view of the hose taken along lines 7—7 of FIG. 1.

FIG. 7 is a sectional view of a first embodiment of the flexible conduit taken along line 7—7 of FIG. 1. In this embodiment, the solution tube 26, first agitation member conduit 250, pump motor conduit 282, vacuum motor conduit 292 and electrical cord 270 are mounted to the outside surface of the flexible conduit 16. As seen in FIG. 1, straps 306 are mounted periodically along the length of the conduit 16 to secure the several conduits to the conduit 16.

Figure 8:
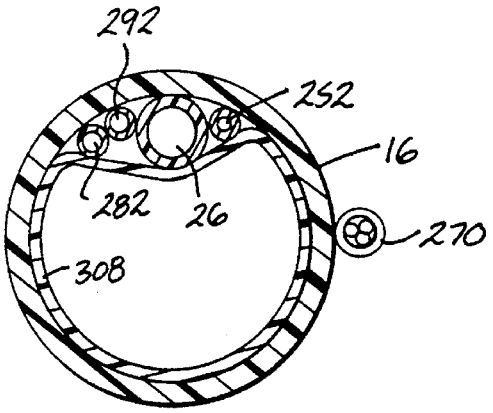
FIG. 8 is a sectional view like FIG. 7 of an alternative embodiment of the hose.
Figure 9:
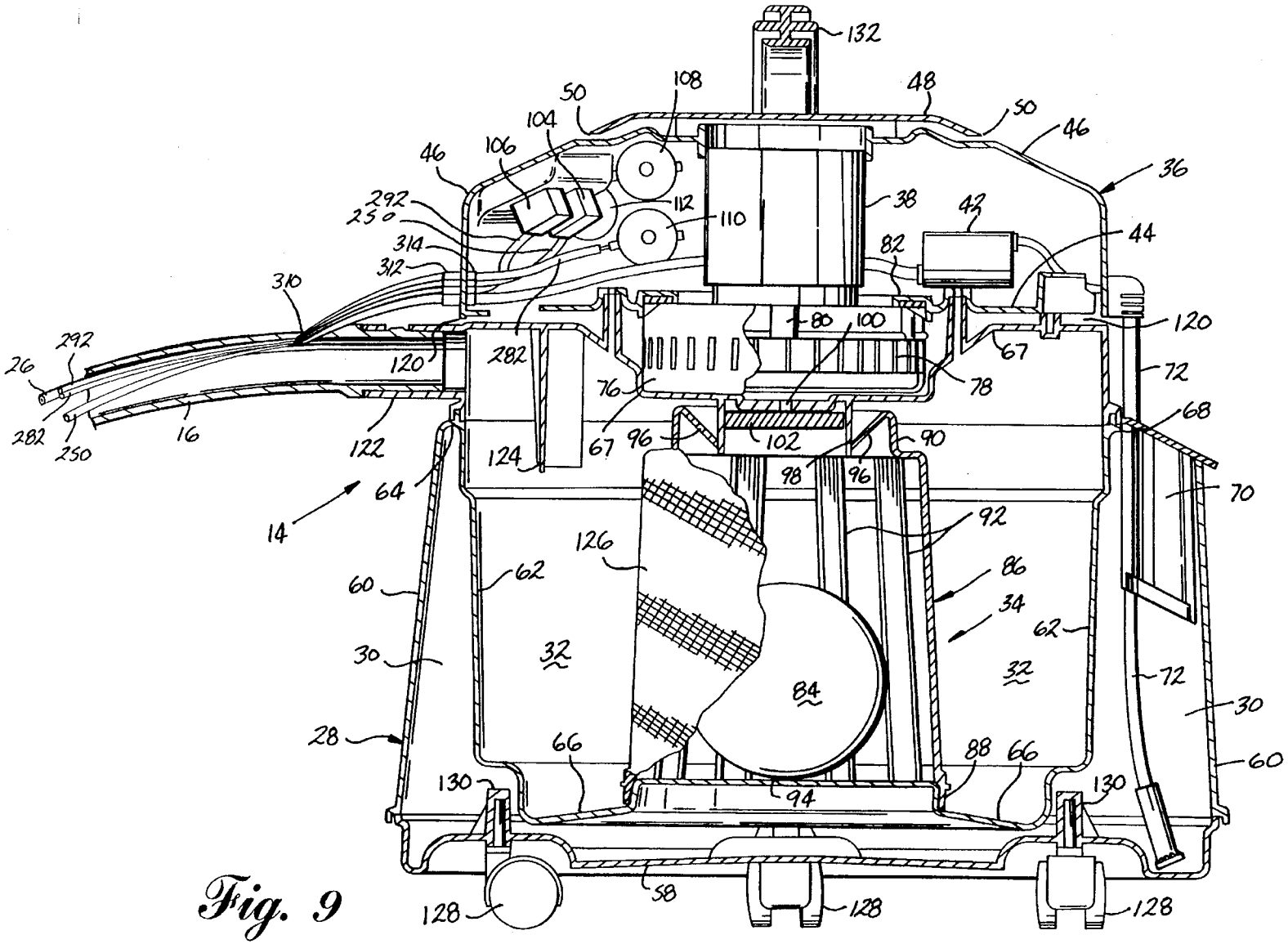
FIG. 9 is a partial sectional view like FIG. 2 of the housing of the combination vacuum cleaning/water extraction machine showing the mounting of the alternative embodiment of the hose of FIG. 8 to the housing.

FIGS. 8 and 9 show a second embodiment for the flexible conduit 16. In this embodiment, the solution tube 26, first agitation member conduit 250, pump motor conduit 282, and vacuum motor conduit 292 are mounted on the interior of the flexible conduit 16. A suction hose 308 is also mounted on the interior of the flexible conduit 16 to separate the several conduits from the dirt, dust, and water which is conveyed from the power foot 22 to the housing 14 through the suction hose 308. The electrical cord 270 is mounted to the exterior surface of the flexible conduit 16. As seen in FIG. 9, the several conduits exit the interior of the flexible conduit 16 through an aperture 310 formed immediately adjacent to the wand mounting 122. Preferably, the several conduits are mounted to a male connector 312 which engages a complementary female connector 314 in the motor housing 36 to permit selective mounting of the several conduits to the motor housing 36.

Figure 10:
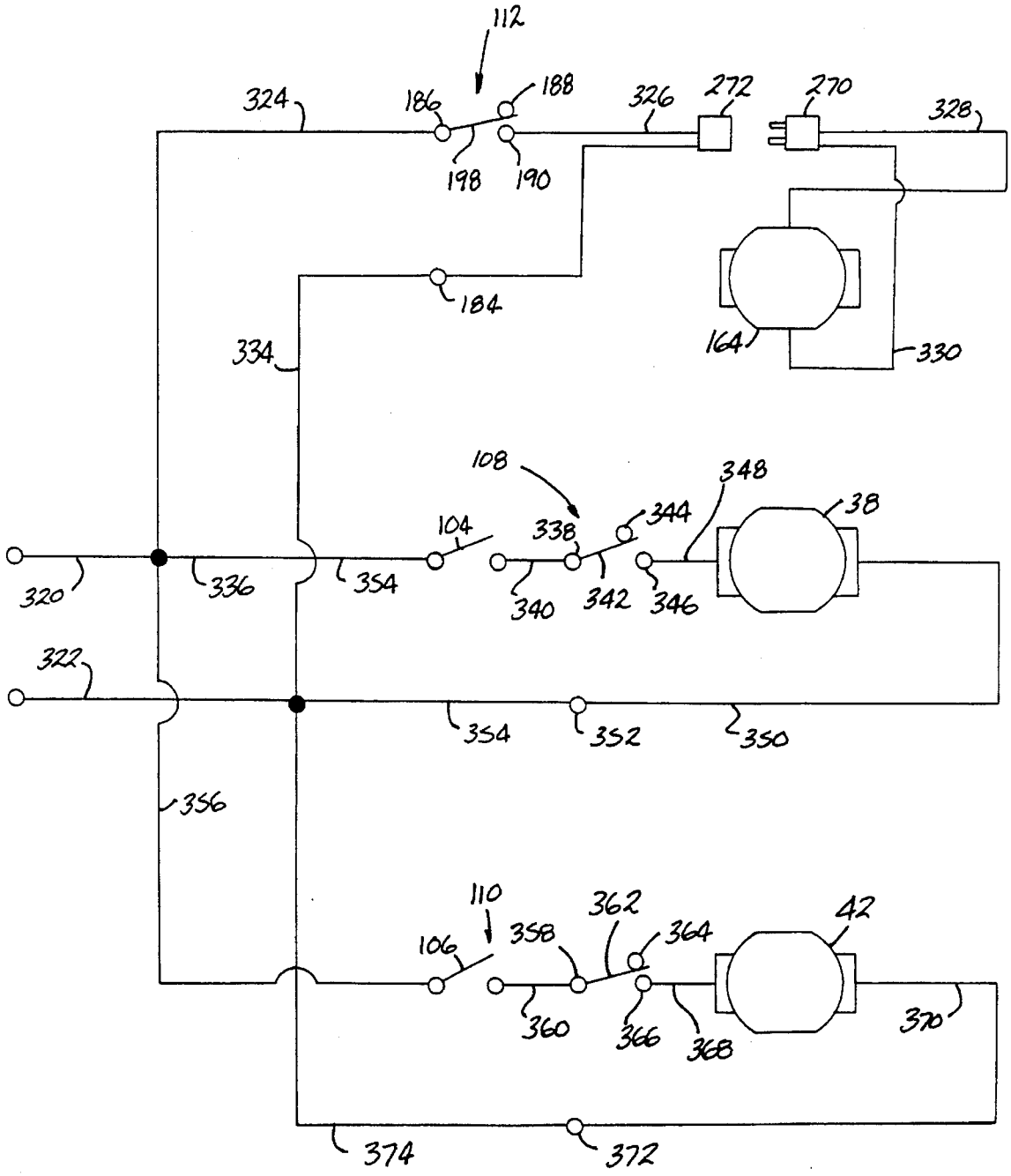
FIG. 10 is a schematic diagram of the electrical circuit of the vacuum cleaning/water extraction machine and power foot according to the invention.

FIG. 10 depicts the electrical schematic diagram for the preferred embodiment of the machine 12 according to the invention. The electrical cord 24 (FIG. 1) comprises a first lead line 320 and a second lead line 322. An agitation motor lead line 324 interconnects the first lead line 320 and an input terminal 186 of the power foot pneumatic switch 112. The arm 198 of the switch 112 is selectively in contact with a first output terminal 188 and a second output terminal 190. The first output terminal 188 is dead. The second output terminal 190 is interconnected to the one terminal of the female plug 272 through a first lead line 326 of the first electrical cord 270. One terminal of the male plug 276 is interconnected to the agitation member motor 164 through a first lead line 328 of the second electric cord 274. The second lead line 330 of the second electrical cord 274 interconnects the agitation member motor 164 with the second terminal of the male plug 276. The second terminal of the female plug 272 is interconnected to a common ground terminal 184 of the switch 112 through a second lead line 332 of the first electrical cord 270. The common ground terminal 184 of the switch 112 is interconnected to the second lead line 322 of the electrical cord 24 through a second agitation motor lead line 334.

The first lead line of the electrical cord 24 is interconnected to the vacuum motor toggle switch 104 through a first vacuum motor lead line 336. The vacuum motor toggle switch 104 is electrically connected to an input terminal 338 of the vacuum motor pneumatic switch 108 through an input lead line 340. The arm 342 of the vacuum motor pneumatic switch 108 is received between a first output terminal 344 and a second output terminal 346. The first output terminal 344 is dead. The second output terminal 346 is interconnected to the vacuum motor 38 through a second vacuum motor lead line 348. A third vacuum motor lead line 350 interconnects the vacuum motor 38 and the common ground terminal 352 of the vacuum motor switch 108. A fourth vacuum motor lead line 354 interconnects the common ground terminal 352 of the vacuum motor switch 108 to the second lead line 322 of the electrical cord 24.

The first lead line of the electrical cord 24 is interconnected to the pump motor toggle switch 106 through a first pump motor lead line 356. The pump motor toggle switch 106 is electrically connected to an input terminal 358 of the pump motor pneumatic switch 110 through an input lead line 360. The arm 362 of the pump motor pneumatic switch 110 is received between a first output terminal 364 and a second output terminal 366. The first output terminal 364 is dead. The second output terminal 366 is interconnected to the pump motor 42 through a second pump motor lead line 368. A third pump motor lead line 370 interconnects the pump motor 42 and the common ground terminal 372 of the pump motor switch 110. A fourth pump motor lead line 374 interconnects the common ground terminal 372 of the pump motor switch 110 to the second lead line 322 of the electrical cord 24.

While the preferred embodiment incorporates toggle switches 104, 106 for the vacuum motor 38 and pump motor 42, respectively, these switches can be removed such that the completion of the electrical circuit is controlled entirely by the vacuum motor and pump motor pneumatic switches 108, 110, respectively. Alternatively, the vacuum motor and pump motor pneumatic switches 108, 110 can be removed and the completion of the electrical circuit of the vacuum motor 38 and pump motor 42 can be controlled entirely by the toggle switches 104, 106, respectively. In addition, the female/male plug 272, 276 can be eliminated and a single electrical cord extending between the motor housing 36 and the power foot 22 in substitution for the first and second electrical cords 270, 274.

Elimination of the vacuum motor pneumatic switch 108 and the pump motor pneumatic switch 110 would also include elimination of the vacuum motor bladder 290 and the pump motor bladder 280.

An example of a pneumatic switch suitable for use according to the invention is manufactured by Eaton GmbH of Germany and identified as Models A1-142 and A1-143. Preferably, the pneumatic switches comprise conventional double pull, single throw, pneumatically operated switches. However, a single pull, single throw switch can also be used.

The three pneumatic switches 108, 110 and 112 disclosed herein are identical in structure but can have different electrical ratings. Therefore, only one switch will be described in detail. As seen in FIGS. 11–14, the pneumatic switch 108 comprises a lower housing 170, an upper housing 172 and a diaphragm 174 mounted between the two housings. The upper housing has an air inlet 176 which is in fluid communication with a first air-tight chamber 178 defined between the diaphragm 174 and the upper housing 172. The outer edge of the diaphragm 174 is supported between an upper housing shoulder 180 and a lower housing shoulder 182. The center portion of the diaphragm 174 is free to flex in response to changes in air pressure in the first chamber 178.

The lower housing 170 receives the four electrical terminals, the common ground terminal 184, the input terminal 186, the first output terminal 188 and the second output terminal 190. The first and second output terminals 188, 190 each have contacts 192, 194 mounted thereto, respectively. The input terminal 186 has a spring-biased lever contact 196 comprising a first arm 198 and a second arm 200. The distal end of the first arm 198 is mounted between the first output terminal contact 192 and the second output terminal contact 194. The proximal end of the first arm 198 is mounted to the proximal end of the second arm 200 and the body of the second arm 200 is received in an aperture 201 formed in the body of the first arm 198. The distal end of the second arm 200 is biased upwardly toward the diaphragm by a guide pin 202 and a helical spring 204. One end of the helical spring 204 is received in the guide pin immediately adjacent the underside of the second arm 200 and the second end of the helical spring 204 is mounted to a projection 206 of the lower housing 170. A guide pin aperture 207 is formed in the second arm 200 to receive one end of the guide pin 202. A C-shaped spring 208 is received on tabs 210, 212 formed on the distal end of the second arm 200 and the distal end of the opening of the first arm 198, respectively. A rigid intermediate member 214 having a diameter less than the diaphragm 174 is mounted to the underside of the diaphragm 174. The intermediate member 214 has a downwardly extending projection 216 which is received on the guide pin 202 and abuts the distal end of the second arm 200.

Figure 11:
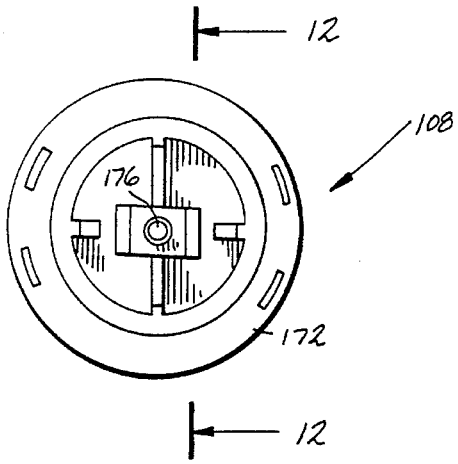
FIG. 11 is a top plan view of a pneumatic switch for use in a machine according to the invention.

The pneumatic switch 108 depicted in FIG. 11 is shown in the off position. In this position, the helical spring 204 biases the guide pin 202, second arm 200, intermediate member 214 and diaphragm 174 upwardly. The C-shaped spring 208 interconnecting the distal ends of the first and second arms 198, 200, causes the second arm 200 to be biased downwardly when the first arm 198 is biased upwardly. In this position, the first arm 198 is in contact with the contact 192 of the first output terminal 188.

When the first chamber 178 receives a small amount of fluid such as air from the agitation member bladder 240, this increases the pressure within the first chamber causing the diaphragm 174 and intermediate member 214 to flex downward relative to the lower housing 170. This downward movement similarly moves the guide pin 202, helical spring 204 and second arm 200 downward relative to the lower housing 170. As this downward motion continues, the point will be reached where the first arm 198 is parallel to the second arm 200 and the C-shaped spring 208 will be under maximum compression. If the second arm 200 moves slightly past this parallel position, then the C-shaped spring 208 will trip the first arm upwardly out of contact with the first output terminal 188 and into contact with the contact 194 of the second output terminal 190. This connection completes the electrical circuit through the pneumatic switch 108.

Figure 12:
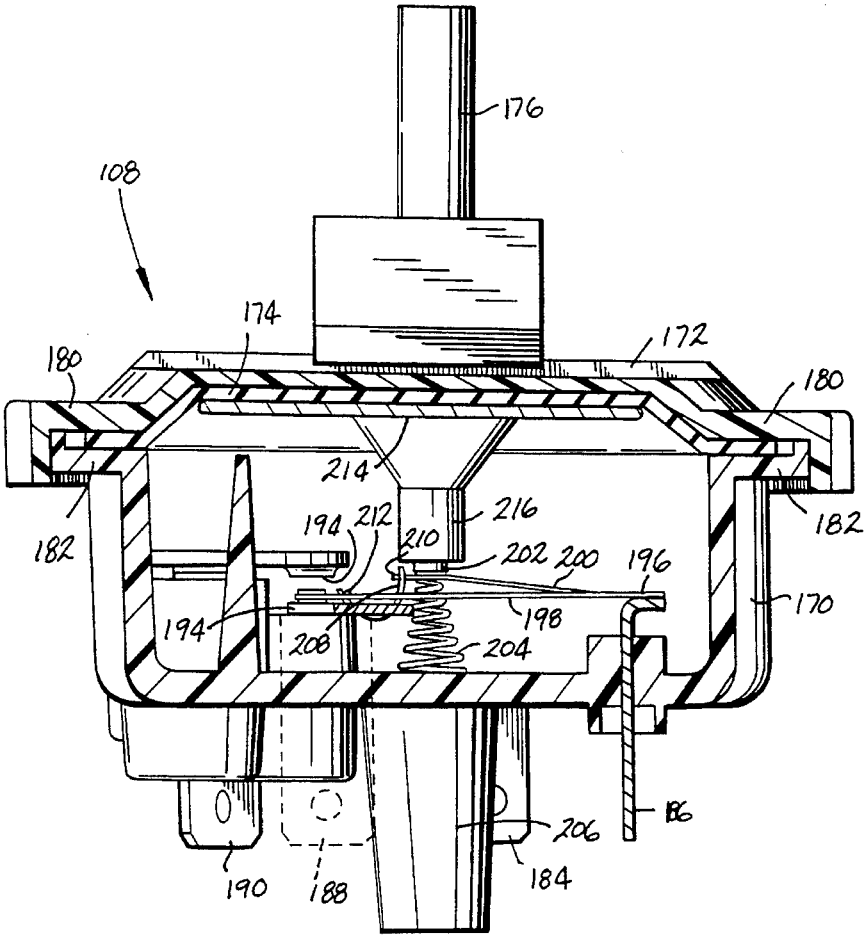
FIG. 12 is a partial sectional view of the pneumatic switch taken along lines 12—12 of FIG. 11, the switch being shown in the off position.
Figure 13:
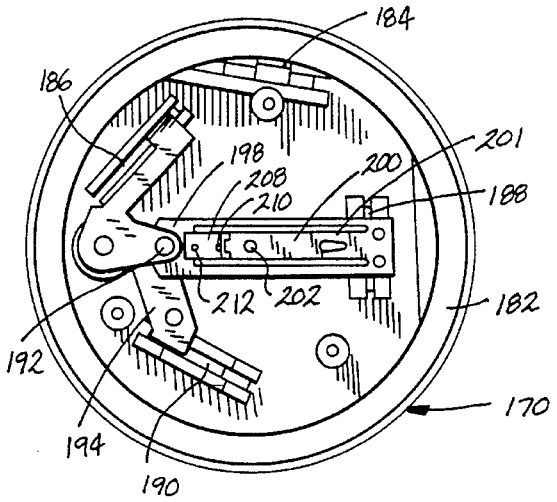
FIG. 13 is a top plan view of the lower housing of the pneumatic switch.
Figure 14:
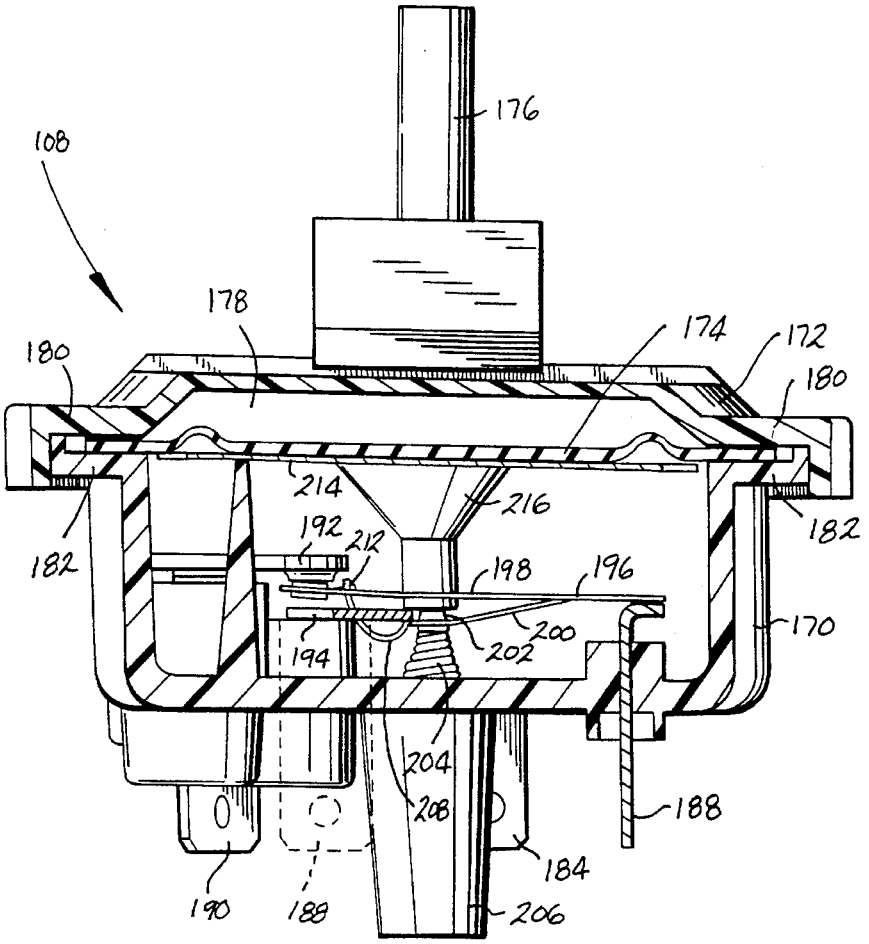
FIG. 14 is a partial sectional view of the pneumatic switch of FIG. 12 shown in the closed position.

When the increased air pressure within the first chamber 178 is released, the helical spring 204 biases the second arm 200 upwardly until the point is reached where the first and second arms 198, 200 are parallel, placing the C-shaped spring 208 under maximum compression. Continued movement of the second arm 200 causes the first arm to snap from the on position as seen in FIG. 14 to the off position as seen in FIG. 12, thereby bringing the first arm 198 out of contact with second output terminal 190 and back in contact with first output terminal 188 as seen in FIG. 12.

In use, the user assembles the grip tube and the wand 20 such that the open end 254 of the second bladder conduit 252 is closed. The user assembles the female/male plug 272, 276 and mounts the second solution tube 27 to the valve housing 278. Warm water and a measured amount of cleaning solution are poured into the clean solution chamber 30 through the loading/discharge aperture 68. The user turns the vacuum toggle switch 104 and the pump motor toggle switch 106 to the on position and then depresses the lever arm 288 of the solution trigger 230. This squeezing of the solution trigger squeezes the pump motor bladder 280 and completes the electrical circuit between the pump motor 42 and the source of electricity to cause rotation of the agitation number 154. Therefore, the cleaning solution is conveyed from the cleaning solution chamber 30 to the power foot 22 for distribution on the surface to be cleaned. As the solution is being sprayed onto the surface to be cleaned, the user can selectively squeeze the agitation member motor bladder 240 to complete the electrical circuit between the agitation member motor 164 and the source of electricity. The rotation of the agitation member 154 enhances the cleaning performance of the machine 12.

After the desired amount of solution has been distributed to the surface to be cleaned, the user releases the solution trigger 230 causing the pump motor bladder 280 to expand to its original state and releasing the increased air pressure from the pump motor pneumatic switch 110 thereby turning off the pump motor. Next, the user squeezes the vacuum motor bladder 290 to trip the vacuum motor pneumatic switch 108 causing the source of suction to be applied to the surface to be cleaned. The dirty water is conveyed from the power foot 22 through the wand 20, the grip tube 18, and the flexible conduit 16 to the dirty solution chamber 32. Through the use of the several bladders mounted to the grip tube 18, the user can easily switch between distributing solution, agitation of the surface to be cleaned and application of the vacuum suction as desired.

The pneumatic switch and grip tube/wand connection described above provides an effective way to selectively prevent the completion of an electrical circuit between the source of electricity and the agitation motor. Persons skilled in the art will understand other methods of interconnecting the grip tube and the wand are available to selectively control the flow of fluid from the agitation motor bladder to the agitation motor pneumatic switch.

While particular embodiments of the invention have been shown, it will be understood, of course, that the invention is not limited thereto since modifications may be made by those skilled in the art, particularly in light of the foregoing teachings. For example, the grip tube 18 can be built into the upper end of the wand 20 and the bladders 240, 290 and 280 can be connected to the pressure conduits 252, 292 and 282, respectively, only when the wand 20 is joined to the flexible conduit 16. In this embodiment, the bladders have only one opening which is connected to a respective conduit when the flexible conduit 16 and the wand 20 are coupled together. Otherwise, the operation of the pressure switches are the same.

Reasonable variation and modification are possible within the scope of the foregoing disclosure of the invention without departing from the spirit of the invention.

The embodiments of the invention in which an exclusive property or privilege is claimed are defined as follows:

1. A floor cleaning appliance comprising:

a housing;

a source of suction in the housing;

a receptacle in the housing for receiving collected dirt and dust;

a power foot having a suction nozzle;

a conduit extending between the housing and the suction nozzle, the conduit comprising a flexible hose having two ends and a rigid wand having first and second ends, one end of the hose being mounted to the source of suction in the housing, the first end of the wand being mounted to the power foot and the second end of the wand being selectively mounted to another end of the flexible hose;

an agitation member mounted in the power foot and adapted to agitate a surface to be cleaned;

an agitation member motor mounted in the power foot, interconnected to said agitation member and adapted to impart an agitation force to the agitation member;

an electrical circuit between the agitation motor and the housing, said electrical circuit including a connector between said flexible hose and said rigid wand and a normally open agitation motor pneumatic switch adapted to switch between open and closed positions in response to changes in fluid pressure applied to the switch, the closed position corresponding to a closed electrical circuit between the agitation member motor and the housing and the open position corresponding to an open electrical circuit between the agitation member motor and the housing;

a manual pressure controller mounted to the flexible hose and connected to the agitation motor pneumatic switch for selectively applying pneumatic pressure to the agitation motor pneumatic switch to close the same, the pressure controller having an opening which, when open, renders the pressure controller ineffective for actuating the agitation motor pneumatic switch; and a closure member mounted on the rigid wand and connected to the manual pressure controller opening for closing the controller when the rigid wand is properly mounted to the flexible hose to thereby render said manual pressure controller operable to supply pneumatic pressure to said agitation motor pneumatic switch when said flexible hose and said rigid wand are properly connected together and to render said manual pressure controller inoperable to supply pneumatic pressure to said agitation motor pneumatic switch when said flexible hose and said rigid wand are disconnected from each other;

whereby, electrical energy can normally be supplied to said connector only when said rigid wand is connected to said flexible hose.

2. A floor cleaning appliance according to claim 1 wherein said manual pressure controller comprises:

an agitation motor bladder having the manual pressure controller opening formed therein; and a fluid conduit interconnecting the agitation motor bladder and the agitation motor pneumatic switch;

whereby the agitation motor pneumatic switch selectively closes when the flexible hose is properly interconnected to the wand in response to squeezing of the agitation motor bladder and the agitation motor pneumatic switch is open when the flexible hose is not properly mounted to the wand.

3. A floor cleaning appliance according to claim 1 wherein the closure member comprises a tongue formed on the second end of the wand and further comprising a complementary groove formed on the other end of the flexible hose, and the manual pressure controller opening is closed when the tongue and groove are interengaged.

4. A floor cleaning appliance according to claim 1 wherein said closure member comprises a projection mounted to the second end of the wand and adapted to be received in the manual pressure controller opening to close the opening when the other end of the flexible hose is properly mounted to the second end of the wand.

5. A floor cleaning appliance according to claim 1 wherein the source of suction comprises a vacuum motor and the appliance further comprises;

a vacuum motor pneumatic switch electrically connected to said vacuum motor and adapted to switch between open and closed positions in response to changes in fluid pressure applied to the vacuum motor pneumatic switch, the closed position corresponding to the closing of a second electrical circuit including the vacuum motor and the open position corresponding to an opening of the second electrical circuit; and a second manual pressure controller mounted on one of the flexible hose and the rigid wand and connected to the vacuum motor pneumatic switch for manually controlling the pressure applied to said vacuum motor control switch;

whereby the operation of the vacuum motor is controlled from one of the wand and the flexible hose.

6. A floor cleaning appliance according to claim 1 and further comprising;

a cleaning solution reservoir mounted in the housing;

a pump motor mounted in the housing and in fluid communication with the reservoir;

a spray nozzle mounted in the power foot and adapted to distribute cleaning solution on a surface to be cleaned;

a spray nozzle conduit extending between the pump motor and the spray nozzle to convey cleaning solution from the pump motor to the spray nozzle;

a pump motor pneumatic switch electrically connected to said pump motor and adapted to switch between open and closed positions in response to changes in fluid pressure in the pump motor pneumatic switch, the closed position corresponding to the closing of a third electrical circuit including the pump motor, and the open position corresponding to an opening of the third electrical circuit; and a third manual pressure controller mounted on one of the flexible hose and the rigid wand and connected to the pump motor pneumatic switch for manually controlling the pressure applied to said pump motor pneumatic switch;

whereby the operation of the pump motor can be manually controlled from the one of the wand and the flexible hose.

7. A floor cleaning appliance according to claim 6 further comprising a trigger having a lever arm, the trigger being pivotally mounted to the one of the flexible hose and the wand and being adapted to control the flow of cleaning solution from the pump motor to the power foot and wherein the third manual pressure controller is mounted between the trigger lever arm and the one of the flexible hose and the wand such that squeezing of the trigger lever arm relative to the one of the flexible hose and the wand activates the third manual pressure controller.

8. A floor cleaning appliance according to claim 6 and further comprising a pneumatic conduit between the first manual pressure controller and the agitator motor pneumatic switch, and wherein the spray nozzle conduit and the agitation motor conduit are mounted within the flexible hose.

9. A floor cleaning appliance according to claim 1 wherein the appliance comprises a combination vacuum cleaning/water extraction machine.

10. An interconnection assembly for use with a water extraction cleaning machine wherein the cleaning machine comprises a power foot having an agitation member motor mounted therein for imparting agitation to an agitation member mounted in the power foot, a source of suction and a flexible hose mounted at one end to the source of suction, the assembly being adapted to control the completion of an electrical circuit between a source of electricity and the agitation member motor mounted in the power foot, the assembly comprising;

a grip tube having first and second ends, the first end being mounted to the flexible hose;

a wand having a first end adapted to be mounted to the power foot and a second end selectively mounted to the second end of the grip tube;

an agitation motor bladder mounted to the grip tube and having an opening formed therein;

a closure member mounted to the wand and adapted to close the opening in the bladder when the grip tube is properly mounted to the wand, the opening in the bladder being open when the grip tube is not properly mounted to the wand;

a normally open agitation motor pneumatic switch adapted to be mounted in the electrical circuit between the agitation motor and the source of electricity, the switch being adapted to close in response to the application of fluid pressure within the switch to close the electrical circuit between the agitation member motor and the source of electricity; and an agitation motor conduit extending between the agitation motor bladder and the agitation motor pneumatic switch;

the bladder being ineffective to apply pressure to the agitation motor pneumatic switch when the bladder opening is open;

whereby the agitation motor pneumatic switch selectively closes when the wand is properly mounted to the grip tube and in response to squeezing of the agitation motor bladder and the agitation motor pneumatic switch is open when the wand is not properly mounted to the grip tube even in response to squeezing of the bladder as a result of fluid pressure venting from the bladder through the opening of the bladder.

11. An interconnection assembly for use with a water extraction cleaning machine according to claim 10 and further comprising a vacuum motor bladder, a vacuum motor pneumatic switch and a vacuum motor conduit extending between the vacuum motor conduit and the vacuum motor pneumatic switch, the vacuum motor pneumatic switch being electrically connected to a vacuum motor and adapted to switch between open and closed positions in response to changes in fluid pressure within the vacuum motor pneumatic switch, the closed position corresponding to a closed electrical circuit between the vacuum motor and the source of electricity and the open position corresponding to an open electrical circuit between the vacuum motor and the source of electricity;

whereby the vacuum motor pneumatic switch selectively switches to the closed position in response to squeezing of the vacuum motor bladder which results in an increase in the fluid pressure within the vacuum motor pneumatic switch and the vacuum motor pneumatic switch switches to the open position when the squeezing pressure on the vacuum motor bladder is released due to the decrease in fluid pressure within the vacuum motor bladder and vacuum motor pneumatic switch.

12. An interconnection assembly for use with a water extraction cleaning machine according to claim 10 and further comprising;

a pump motor pneumatic switch electrically connected to a pump motor and adapted to switch between open and closed positions in response to changes in fluid pressure in the pump motor pneumatic switch, the closed position corresponding to a closed electrical circuit between the pump motor and the source of electricity and the off position corresponding to an open electrical circuit between the pump motor and the source of electricity;

a pump motor bladder; and a pump motor conduit interconnecting the pump motor bladder and the pump motor pneumatic switch;

whereby the pump motor pneumatic switch selectively switches to the closed position in response to squeezing of the pump motor bladder as a result of an increase in the fluid pressure within the pump motor pneumatic switch and the pump motor pneumatic switch switches to the open position when the squeezing pressure on the pump motor bladder is released due to a decrease in fluid pressure within the pump motor bladder and pump motor pneumatic switch.

13. An interconnection assembly for use with a water extraction cleaning machine according to claim 12 and further comprising a trigger having a lever arm, the trigger being pivotally mounted to the grip tube and being adapted to control the flow of a cleaning solution from the pump motor to the power foot wherein the pump motor bladder is mounted between the trigger lever arm and the grip tube such that squeezing of the trigger lever arm relative to the grip tube squeezes the pump motor bladder.

14. An interconnection conduit assembly for use with a water extraction cleaning machine according to claim 10 wherein said bladder opening is mounted adjacent the second end of the grip tube.

15. An interconnection conduit assembly for use with a water extraction cleaning machine according to claim 10 wherein said closure member comprises a projection mounted to the second end of the wand and adapted to be received in the bladder opening when the grip tube is properly mounted to the wand, thereby closing the bladder opening.

16. An interconnection conduit assembly for use with a water extraction cleaning machine according to claim 10 wherein said closure member comprises a tongue formed on the second end of the wand and further comprising a complementary groove formed on the other of the second end of the grip tube, the bladder opening being closed when the tongue is received in the groove.

* * * * *